US005959408A

United States Patent [19]

Steel et al.

[11] Patent Number: 5,959,408

[45] Date of Patent: Sep. 28, 1999

[54] SYMMETRY CONTROL CIRCUIT FOR PRE-HEATING IN ELECTRONIC BALLASTS

[75] Inventors: John F. Steel, Fort Wayne, Ind.; Bryce L. Hesterman, Madison, Ala.

[73] Assignee: MagneTek, Inc., Nashville, Tenn.

[21] Appl. No.: 08/908,393

[22] Filed: Aug. 7, 1997

[51] Int. Cl.[6] ..... H05B 37/02

[52] U.S. Cl. ..... 315/106; 315/224; 315/291; 315/DIG. 7

[58] Field of Search ..... 315/105, 106, 315/224, 307, 291, DIG. 7

[56] References Cited

U.S. PATENT DOCUMENTS

| | | | |
|---|---|---|---|
| 4,647,817 | 3/1987 | Fahnrich et al. | 315/104 |
| 4,935,669 | 6/1990 | Nilssen | 315/105 |
| 4,983,887 | 1/1991 | Nilssen | 315/224 |
| 5,023,488 | 6/1991 | Gunning | 307/475 |
| 5,028,818 | 7/1991 | Go Ang et al. | 307/443 |
| 5,245,253 | 9/1993 | Quazi | 315/224 |
| 5,430,404 | 7/1995 | Campbell et al. | 327/566 |
| 5,583,402 | 12/1996 | Moisin et al. | 315/307 |
| 5,650,925 | 7/1997 | Hesterman | 363/132 |

FOREIGN PATENT DOCUMENTS

| | | |
|---|---|---|
| 3208607 | 12/1982 | Germany . |
| 3338464 | 5/1985 | Germany . |

OTHER PUBLICATIONS

Magnetek SPA Italy Ballast 6028 Schematic by David Martini Feb. 16, 1994.

*Primary Examiner*—Michael B Shingleton
*Attorney, Agent, or Firm*—Waddey & Patterson; Mark J. Patterson

[57] ABSTRACT

A symmetry control circuit for a ballast driving a gas discharge lamp. The circuit controls the pre-heat time of a gas discharge lamp with heatable filaments by holding off the full striking voltage until the lamp has had sufficient time to pre-heat. The circuit is designed to work with electronic ballasts and especially electronic ballasts without boost power factor correction to properly pre-heat the lamp. A control circuit reduces the duty cycle in an inverter transistor, thereby keeping the voltage across the lamp low while allowing filament heating to occur. The control circuit is disabled after a time interval of about 500 ms, allowing the transistor duty cycle to increase to 50 percent, the lamp voltage to rise, and the properly pre-heated lamp to ignite.

13 Claims, 1 Drawing Sheet

SYMMETRY CONTROL CIRCUIT FOR PRE-HEATING IN ELECTRONIC BALLASTS

BACKGROUND OF THE INVENTION

This invention relates to a control circuit for controlling the starting of a gas discharge lamp powered by an electronic ballast. More specifically, it relates to controlling the pre-heat time of a gas discharge lamp by holding off the full striking voltage until the filaments have had sufficient time to pre-heat.

Many present day gas discharge lamps are powered by electronic ballasts which operate the lamp at a frequency above 25 kHz to obtain higher efficiency than what is possible with 60 Hz operation. Many electronic ballasts consist of a rectifier to convert 60 Hz AC to DC, a boost circuit to increase the DC voltage and achieve power factor correction, and an inverter to convert the DC to high frequency AC.

Several pre-heating techniques are currently known in the prior art. Many present day ballasts preheat the lamp filaments with a voltage supplied from the inverter before the boost circuit comes on. Once the boost circuit starts, the voltage at the ballast output terminals will rise to a level sufficient to strike the lamp arc. An example of this technique is shown in U.S. Pat. No. 5,650,925 titled "Diode Clamping Arrangement for Use in Electronic Ballasts." This technique is not applicable in ballast circuits that do not use active power factor correction.

Another pre-heating technique is to use frequency shifting. This technique is illustrated in German laid open patent application DE 3208607 titled, "Ballast for at least one load which is periodically ignited and powered by a generator." It is also shown in U.S. Pat. No. 4,935,669 titled, "Two mode electronic ballast." These patents show a ballast circuit that operates at a high initial frequency that is approximately double the full load switching frequency of the resonant inverter output circuit. During this initial high frequency operation, the voltage developed in the resonant circuit is insufficient to light the lamp. After the lamp filaments are heated, the frequency is reduced to the full-load switching frequency and the voltage across the resonating inverter output circuit rises to cause the lamp arc to strike. This frequency shifting approach suffers from requiring a complicated circuit to adjust the operating frequency.

A third preheating technique utilizes a thermistor to reduce the ballast output voltage during preheating. This technique, shown in U.S. Pat. No. 4,647,817, has reduced efficiency because the thermistor dissipates substantial heat even after it has changed to a high-resistance state.

Several symmetry control circuits have been shown in the prior art. One is shown in U.S. Pat. No. 5,583,402 titled "Symmetry Control Circuit and Method." This circuit shows a symmetry control circuit which modulates the duty cycle of the lower transistor in a half-bridge configuration in order to dim the lamps. A second symmetry control circuit is shown in U.S. Pat. No. 4,983,887. This patent discloses using the symmetry control technique to modulate the duty cycle of the lower transistor in a half-bridge configuration in order to limit the open circuit voltage during ballast operation in order to prevent damage to components in the circuit. A third symmetry control circuit is shown in German patent DT 3338464 titled, "High Frequency Brightness Control Device for Fluorescent Lamps." This circuit shows a symmetry control circuit which modulates the duty cycle of the lower transistor in a half-bridge configuration in order to dim the lamps. It does not show controlling the ballast for pre-heating the lamp. None of these three patents teach using symmetry control for lamp pre-heating.

Another symmetry control circuit is shown by a ballast produced in February of 1994 in Italy by MagneTek S.p.A. This ballast employs a symmetry control technique to control the duty cycle of the lower transistor in a half-bridge inverter during start-up and operation. The inverter is self-oscillating. The schematic of this ballast shows a NPN transistor Q5 that is used to adjust the duty cycle of the lower power switch Q3 by turning Q3 off before the time when it would naturally turn off. A capacitor C3 is linked to the midpoint of the half bridge, and is discharged when Q3 turns on. A PNP transistor Q8 is biased to form a current source that is connected to capacitor C3, and begins to charge it after it is discharged. When C3 is sufficiently charged, a PNP transistor Q4 turns off, and NPN transistor Q5 turns on, which turns off transistor Q3, thereby limiting the duty cycle of transistor Q3. During preheating, the charging current provided by Q8 is held high by a timer circuit, and the duty cycle of Q3 is held low so that the ballast output voltage will be low. After the preheat interval, a regulator circuit controls the current provided by Q8, which adjusts the duty cycle of Q3 so that the lamp current can be maintained at the desired level. This ballast requires a large number of components, and is expensive to produce.

An unmet need currently exists in the field of ballast design for a simple, inexpensive and efficient circuit to provide filament heating, especially for ballasts without boost power factor correction. This need can be met with a circuit that shifts the symmetry of the square-wave inverter voltage during preheating to produce a low ballast output voltage while the filaments are being heated. After the filaments have had sufficient time to become heated, then the symmetry control is removed and the ballast output voltage rises to a level that allows the lamp to strike.

SUMMARY

An object of the invention is to allow electronic ballasts and, in particular, electronic ballasts without boost power factor correction to properly preheat a gas discharge lamp with heatable filaments prior to ignition of the arc in the lamp.

Another object of the invention is to minimize the amount of filament heating that occurs after the arc in the lamp has ignited.

A ballast circuit drives a lamp from a low frequency AC power source. The ballast provides a high frequency sine wave voltage to the lamp. The ballast circuit preheats filaments in the lamp prior to ignition of an arc in the lamp. A rectifier receives the low frequency AC power source and provides a first DC voltage. An inverter connects to the rectifier. The inverter has a first and a second transistor. The inverter receives the first DC voltage and provides a square wave voltage. A control means is connected with the inverter and operates to shift the symmetry of the square wave by reducing the duty cycle of the second transistor. A resonant output circuit is connected to the inverter and to the lamp. The resonant output circuit provides the high frequency sine wave voltage in response to receiving the square wave voltage. A disable means is connected with the control means and operates to prevent the control means from reducing the duty cycle of the second transistor after a first period of time, such that after operation of the disable means the lamp ignites. In contrast with the operation of the present invention, the symmetry control circuit produced by MagneTek S.p.A. is never disabled, but continues to operate as a current regulating circuit once the preheating interval is over.

BRIEF DESCRIPTION OF THE DRAWINGS

These and other features, aspects and advantages of the present invention will become better understood with regard to the following description, appended claims and accompanying drawings where:

DETAILED DESCRIPTION OF THE PREFERRED EMBODIMENTS

Figure 1:
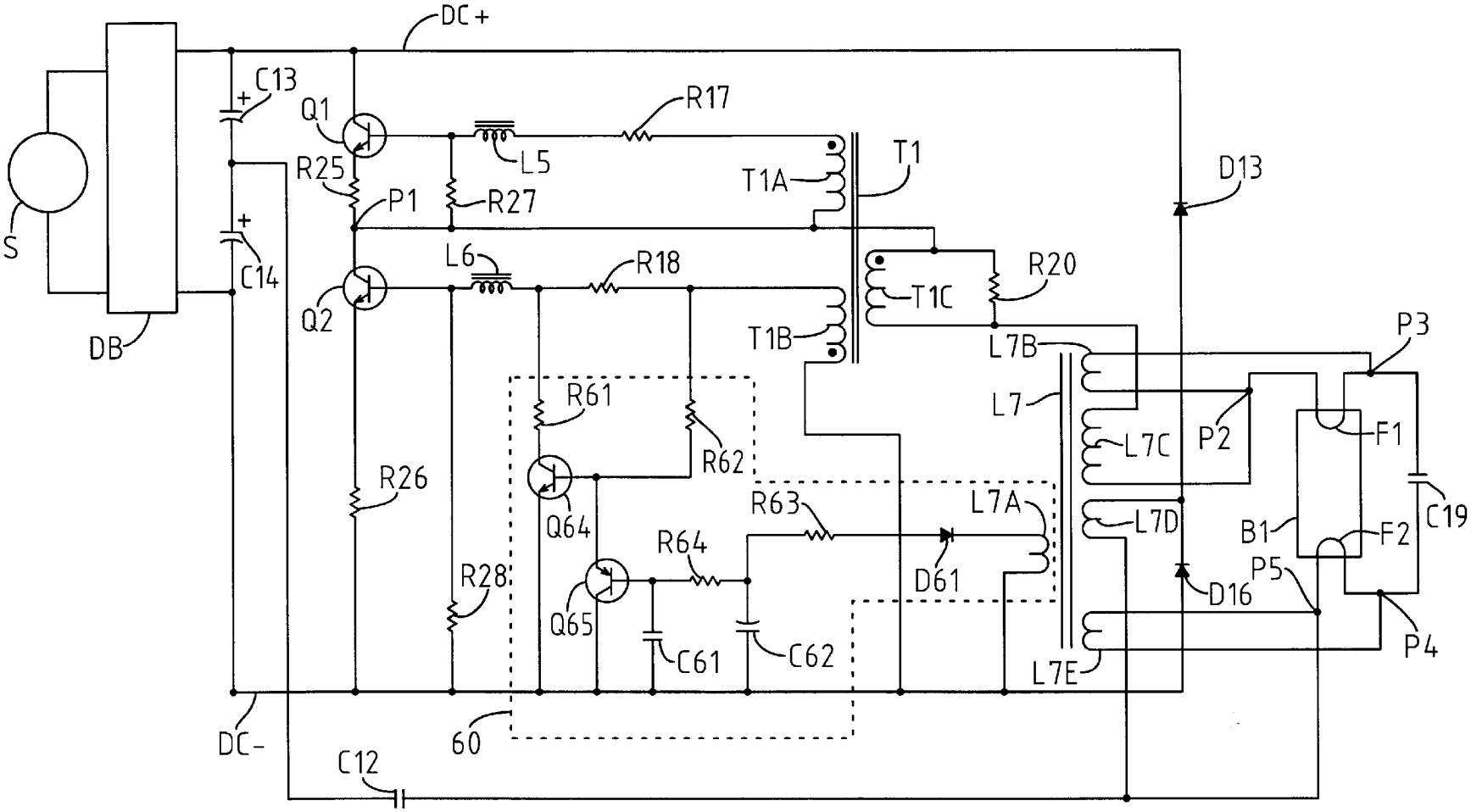
FIG. 1 is a detailed electrical schematic diagram of a preferred embodiment of an electronic ballast of the present invention that employs symmetry-controlled preheating.

Referring to FIG. 1, a series resonant ballast is shown. A low frequency AC power source S supplies power to the ballast through a full-wave rectifier diode bridge DB. A pair of bulk DC storage capacitors C13 and C14 is connected across the diode bridge output and between the circuit buses, which are labeled as the DC+bus and the DC−bus. When power is first applied to the circuit, the series combination of bulk capacitors C13 and C14 is charged to the peak value of the AC line voltage. When the ballast is operating, a relatively constant DC voltage will be present across the series connected bulk storage capacitors.

An inverter consisting of transistors Q1 and Q2 in a half-bridge configuration are connected across the DC+and DC−buses. A diac circuit (not shown) is normally used to trigger the inverter into oscillation. The diac circuit supplies a pulse of current to start oscillations in the inverter. Transistors Q1 and Q2 are forced to conduct in an alternating sequence due to the phasing of windings T1A and T1B of a toroidal transformer T1. Winding T1A is coupled to the base of transistor Q1 through the series combination of a resistor R17 and an inductor L5. Similarly, winding T1B is coupled to the base of transistor Q2 through the series combination of a resistor R18 and an inductor L6. Resistors R17 and R18 limit the forward base currents in transistors Q1 and Q2, while inductors L5 and L6 reduce the fall-time of the collector currents of transistors Q1 and Q2. A resistor R27 is connected between the base of Q1 and terminal P1. Resistor R28 is connected between the base of Q2 and the DC−bus. Resistors R27 and R28 help to prevent the inverter from oscillating when the lamps are removed. A resistor R25 is connected between the emitter of Q1 and terminal P1. Resistor R26 is connected between the emitter of Q2 and the DC−bus. Resistors R25 and R26 help the transistors to turn off without having a large negative voltage applied to the base. During operation a square wave voltage will be present at terminal P1, which is the inverter output terminal. Transistors Q1 and Q2 each have a duty cycle, which is the ratio of the on time of the transistor to the total period.

A primary winding T1C of toroidal transformer T1 is connected between output terminal P1 and one end of a winding L7C of a resonant inductor L7. The other end of winding L7C is connected to a terminal P2 of lamp B1. The current flowing in winding T1C is the source of the base drive current supplied by windings T1A and T1B. A resonating capacitor C12 has one end connected between the junction of bulk capacitors C13 and C14. The other end of capacitor C12 is connected to terminal P5 of lamp B1. Capacitor C12 could alternatively be connected to either the positive terminal of capacitor C13 or the negative terminal of capacitor C14. The resonant circuit formed by resonant inductor L7, and resonant capacitors C12 and C19 converts the square wave voltage to a high frequency sine wave voltage which is applied to the lamps.

A clamping circuit is used to limit the starting voltage applied to the lamps. Diodes D13 and D16 are connected in series such that the cathode of diode D13 is connected to the DC+bus and the anode of diode D16 is connected to the DC−bus. The junction of these diodes is connected to one end of a winding L7D on inductor L7. The other end of winding L7D is connected to the junction of terminal P5 and resonant capacitor C12. When lamp B1 is connected to an operating ballast but is not yet lit, the sine wave voltage between terminals P2 and P5 will rise until diodes D13 and D16 alternately conduct and limit the sine wave voltage. The operation of this clamping circuit is described more fully in U.S. Pat. No. 5,650,925 "Diode Clamping Arrangement for use in Electronic Ballasts."

Lamp B1 has terminals P2, P3, P4 and P5. A filament F1 is connected between P2 and P3, and a filament F2 is connected between P4 and P5. Filaments F1 and F2 should be heated appropriately before the lamp is started to prevent them from being damaged. The series resonant ballast shown here is a non-isolated ballast and is typically used with compact fluorescent lamps. Filament F1 is connected to a winding L7B on inductor L7. Similarly, filament F2 is connected to a winding L7E on inductor L7. The windings L7B and L7E provide a voltage to preheat filaments F1 and F2. A resonant capacitor C19 is connected between the ends of filaments F1 and F2. Before the lamp is lit, the path between the two filaments is essentially an open circuit. Capacitor C19 completes a path between terminal P2 and P5 so that oscillations can occur in the inverter.

A symmetry-controlled pre-heat circuit 60 is indicated by the dashed line in FIG. 1. The term symmetry control refers to making the duty cycles of the inverter transistors unequal. The voltage across inductor winding L7A is rectified by diode D61. Winding L7A has one end connected to diode D61 and the other end connected to the DC−bus. A resistor R63 is connected in series with resistor R64 from the anode of diode D61 to the base of transistor Q65. A capacitor C62 is connected from the junction of resistors R63 and R64 to the DC−bus to form a time delay circuit. A capacitor C61 is connected from the base of transistor Q65 to the DC−bus. The collector of transistor Q65 is connected to the DC−bus, and the emitter is connected to the base of transistor Q64. The base of transistor Q64 is connected through a resistor R62 to winding T1B, and the collector is connected through resistor R61 to the base drive circuit of transistor Q2 at the junction of L6 and R18.

Component values for an experimentally built ballast having symmetry-controlled pre-heating are shown in Table 1:

TABLE 1

Component values for FIG. 1.

| Component | Value or Part# | Component | Value or Part# |
|---|---|---|---|
| Q1,Q2 | MJE18004 | R25 | 1 Ω |
| Q64 | 2N4401 | R26 | 1 Ω |
| Q65 | 2N3906 | R27 | 27 Ω |
| C12 | .047 uF | R28 | 27 Ω |
| C61 | .01 uF | R17,R18 | 6.8 Ω |
| C62 | 220 uF | R61 | 1 Ω |
| C19 | 5.6 nF | R62 | 100 Ω |
| D13 | UF4007 | R63 | 20K Ω |
| D16 | UF4007 | R64 | 510K Ω |
| D61 | 1N4148 | R20 | 62 Ω |
| C13, C14 | 33 uF | L5, L6 | 10 uH |

Symmetry-controlled pre-heat circuit 60 delays the ignition of the lamp for a period of time after power is applied to the ballast. In order to properly preheat the lamps, the full starting open circuit voltage supplied to the lamps must be held off for approximately ½ second so that the filaments can be heated by filament windings L7B and L7E. The preheating time needed varies among different lamps. Most lamps will require at least 300 milliseconds of preheating time. To hold off the open circuit voltage, symmetry controlled pre-heat circuit 60 reduces the on time, or duty cycle of transistor Q2 during each inverter cycle during the preheating period. The duty cycle of transistor Q2 would typically be reduced or shifted from a 50 percent duty cycle to a 25 percent duty cycle. This in turn keeps the output sine wave voltage low and prevents the lamp from starting. Alternatively, the duty cycle of transistor Q1 could be reduced.

When power is first applied to the ballast, a diac circuit (not shown) provides a pulse of current to the base of transistor Q2, turning it on, and initiating oscillations in the inverter.

Transistor Q2 is turned on when the non-dotted end of winding T1B becomes sufficiently positive. R62 and Q65 form a voltage divider so that transistor Q64 is turned on as the voltage across winding T1B continues to rise. When transistor Q64 turns on, the base drive current for transistor Q2 is shunted to DC−, which causes transistor Q2 to turn off earlier than it would if transistor Q64 were off. Capacitor C61 ensures that transistor Q65 is on at the beginning of the on-time interval of transistor Q2. This prevents transistor Q64 from turning on so early in the switching cycle that the inverter stops oscillating. The effect of capacitor C61 is most significant when the inverter is being started following the pulse from the diac circuit.

The value of resistors R61, and R62 are selected so that the duty cycle of transistor Q2 is reduced to approximately 25%. Shortening the duty cycle of transistor Q2 keeps the lamp voltage low during the startup period. At the same time, the filament windings L7B and L7E supply sufficient voltage to filaments F1 and F2 for adequate pre-heating.

As the inverter continues to oscillate, capacitor C62 is charged negatively with respect to DC−through resistor R63. After about 500 ms, the voltage across capacitor C62 is charged to a voltage that is negative enough that transistor Q65 pulls the base of transistor Q64 low, thereby turning it off and stopping the reduction of the duty cycle of transistor Q2. The combination of winding L7A, diode D61, resistor R63, resistor R64, capacitors C61 and C62 function as a disable circuit to prevent a control circuit comprising transistor Q64 and resistors R61 and R62 from reducing the inverter duty cycle. Once the disable circuit is activated, the symmetry controlled pre-heat circuit 60 has no effect on the inverter, and the duty cycle of transistor Q2 increases to its full 50% duty cycle. The sine wave output voltage of the resonant circuit then rises to its full value, which typically is 500 volts RMS, allowing the lamp to ignite.

The disable circuit was realized with a negatively charged capacitor C62 because a negatively charged capacitor is also used in the ballast shutdown circuit described in U.S. Pat. No. 5,635,799 "Lamp Protection Circuit for Electronic Ballasts," and both the shutdown circuit and the disable circuit can share the same negatively charged capacitor. The disable circuit could alternatively be realized with a positively charged capacitor and a NPN transistor instead of PNP transistor Q65.

After the lamp has ignited, the voltage across resonant inductor L7 will decrease. Reducing the voltage in the resonant inductor reduces the voltage produced by filament windings L7B and L7E. This provides a cutback in the heating of filaments F1 and F2 after the lamp has struck. Filament heating is no longer required after the lamp has struck an arc. Cutting back the amount of filament heating voltage after arc ignition results in a more energy-efficient ballast.

The present invention has been described in connection with a preferred embodiment thereof, and it will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. A ballast circuit for powering at least one gas discharge lamp and having a plurality of output terminals connected to the gas discharge lamp, the output terminals providing a high frequency sine wave voltage to the lamps, the ballast circuit adapted to preheat a plurality of filaments in the lamp prior to ignition of an arc in the lamp, the ballast circuit comprising:

a DC power supply for providing a first DC voltage;

inverter means connected to the DC power supply, the inverter means having a first and a second transistor, the inverter means operable to receive the first DC voltage and provide a square wave voltage;

control means connected with the inverter means and operable to shift the symmetry of the square wave by reducing a duty cycle of the second transistor thereby causing the ballast circuit to operate in a first mode;

resonant output means connected to the inverter means and to the lamp, the resonant output means operable to provide the high frequency sine wave voltage in response to receiving the square wave voltage; and disable means connected with the control means and operable after a predetermined time in the first operating mode to prevent the control means from reducing the duty cycle of the second transistor such that after operation of the disable means the lamp ignites and operates in a second mode.

2. The ballast circuit according to claim 1, wherein the control means comprises a third transistor.

3. The ballast circuit according to claim 2, wherein the disable means comprises:

time delay means for providing a second DC voltage;

a fourth transistor connected to the time delay means, the fourth transistor operable to turn on and off in response to the second DC voltage.

4. The ballast circuit according to claim 1, wherein the first period of time is greater than 300 milliseconds.

5. A ballast circuit for powering at least one gas discharge lamp, the ballast circuit connected to the gas discharge lamp, the ballast circuit adapted to preheat a plurality of filaments in each lamp prior to ignition of an arc in the lamp, the ballast circuit comprising:

a DC power supply for providing a first DC voltage;

inverter means connected to the DC power supply, the inverter means having a first and a second transistor, the second transistor having a duty cycle, the inverter means operable to receive the first DC voltage and provide a square wave voltage;

control means connected with the inverter means and operable to shift the symmetry of the square wave by reducing a duty cycle of the second transistor, the first mode characterized by providing a magnitude of filament heating voltage sufficient to preheat the filaments and a magnitude of lamp voltage insufficient to strike the lamp; and disable means connected with the control means and operable, after a predetermined interval of ballast operation in the first operating mode, to cause the ballast to operate in a second mode by preventing the control means from reducing the duty cycle of the second transistor, the second mode characterized by providing a magnitude of lamp operating voltage sufficient to ignite and operate the lamp.

6. The ballast circuit according to claim 5, wherein the control means comprises a third transistor.

7. The ballast circuit according to claim 6, wherein the disable means comprises:

time delay means for providing a second DC voltage;

a fourth transistor connected to the time delay means, the fourth transistor operable to turn on and off in response to the second DC voltage.

8. The ballast circuit according to claim 5, wherein the first period of time is greater than 300 milliseconds.

9. A symmetry control circuit for a ballast driving at least one gas discharge lamp, the lamp having a pair of heatable filaments, the ballast providing a filament heating voltage to the heatable filaments prior to ignition of an arc in the lamp, the ballast connected to the gas discharge lamp, the symmetry control circuit comprising:

control means connected with an inverter, the inverter having a first and a second transistor, the first inverter transistor having a first duty cycle, the second inverter transistor having a second duty cycle, the control means operable to reduce the second duty cycle; and disable means connected with the control means and operable to prevent the control means from reducing the duty cycle of the second transistor after a first period of time such that after operation of the disable means the lamp ignites;

the control means providing a first operation mode whereby the second duty cycle is reduced and the disable means providing a second operation mode whereby the control means is disabled and the second duty cycle is not reduced.

10. The symmetry control circuit according to claim 9, wherein the control means comprises a third transistor.

11. The symmetry control circuit according to claim 9, wherein the disable means comprises:

time delay means for providing a second DC voltage;

a fourth transistor connected to the time delay means, the fourth transistor operable to turn on and off in response to the second DC voltage.

12. The symmetry control circuit according to claim 9, wherein the first period of time is greater than 300 milliseconds.

13. The symmetry control circuit according to claim 9, wherein the second duty cycle is approximately 25 percent during the first period of time.

* * * * *